US010278515B2

(12) United States Patent
Mendes et al.

(10) Patent No.: US 10,278,515 B2
(45) Date of Patent: May 7, 2019

(54) ADJUSTABLE BOUNCING FRAME

(71) Applicant: KIDS II, INC., Atlanta, GA (US)

(72) Inventors: Mark Mendes, Loganville, GA (US); Stephen R. Burns, Cumming, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 15/955,142

(22) Filed: Apr. 17, 2018

(65) Prior Publication Data

US 2018/0228300 A1 Aug. 16, 2018

Related U.S. Application Data

(63) Continuation-in-part of application No. 15/657,565, filed on Jul. 24, 2017, now Pat. No. 10,016,067, which is a continuation of application No. 15/259,212, filed on Sep. 8, 2016.

(60) Provisional application No. 62/486,508, filed on Apr. 18, 2017, provisional application No. 62/215,943, filed on Sep. 9, 2015.

(51) Int. Cl.
*A47D 13/04* (2006.01)
*A47D 13/10* (2006.01)

(52) U.S. Cl.
CPC ..... *A47D 13/04* (2013.01); *A47D 13/043* (2013.01); *A47D 13/107* (2013.01)

(58) Field of Classification Search
CPC ..... A47D 13/025; A47D 13/04; A47D 11/00
See application file for complete search history.

(56) References Cited

U.S. PATENT DOCUMENTS

| | | | |
|---|---|---|---|
| 2,252,224 | A | 8/1941 | Welsh |
| 2,758,634 | A | 8/1956 | Welsh et al. |
| 3,145,048 | A | 8/1964 | Dowdy et al. |
| 3,145,999 | A | 8/1964 | Burnham |
| 3,157,430 | A | 11/1964 | Hamilton |
| 3,180,679 | A | 4/1965 | Berlin |
| 3,326,570 | A | 6/1967 | Burnham et al. |
| 3,331,631 | A | 7/1967 | Pierson, Jr. |
| 3,427,071 | A | 2/1969 | Pierson, Jr. |

(Continued)

OTHER PUBLICATIONS

"Storkcraft Mini-Speedster Activity Walker Seat Install Video", {Online}. Retrieved from the Internet: <https://www.youtube.com/watch?v=mEhykl_ctdU>, (Dec. 11, 2018), 137 pgs.

*Primary Examiner* — James A Shriver, II
*Assistant Examiner* — James J Triggs
(74) *Attorney, Agent, or Firm* — Gardner Groff Greenwald & Villanueva, PC

(57) ABSTRACT

An adjustable bouncing frame for a child support device including a support frame coupled between a base portion and a child seat platform of the child support device. The support frame is configured to support the child seat platform a distance above the base portion which rests on a support surface. The adjustable bouncing frame generally includes at least one support member that is slidingly coupled to the child support device at a first end. Lateral movement of the first end of the support member can adjust the height of the child seat platform relative to the base. The frame can also include a resilient member that allows for reciprocal lateral motion of the first end of the support member which results in an up-and-down bouncing motion of the child seat platform.

18 Claims, 13 Drawing Sheets

(56) References Cited

U.S. PATENT DOCUMENTS

| | | | | |
|---|---|---|---|---|
| RE27,255 | E | 12/1971 | Pierson, Jr. | |
| 3,692,359 | A | 9/1972 | Boucher | |
| 4,019,756 | A | 4/1977 | Ishida | |
| 4,045,045 | A | 8/1977 | Boucher et al. | |
| 4,231,582 | A | 11/1980 | Moss | |
| 4,359,242 | A | 11/1982 | Gerken et al. | |
| 4,576,392 | A | 3/1986 | Quinlan, Jr. | |
| 4,579,359 | A | 4/1986 | Schwartz | |
| 4,615,523 | A | 10/1986 | Chen | |
| 4,759,541 | A | 7/1988 | Chen | |
| 4,799,700 | A | 1/1989 | Knoedler et al. | |
| 4,822,030 | A | 4/1989 | Cone | |
| 4,844,209 | A | 7/1989 | Sedlack | |
| 5,031,899 | A | 7/1991 | Chiu | |
| 5,054,851 | A | 10/1991 | Chiu | |
| 5,071,149 | A | 12/1991 | Perego | |
| 5,080,383 | A | 1/1992 | Hsieh | |
| 5,203,581 | A | 4/1993 | Jankowski | |
| 5,244,443 | A | 9/1993 | Cerda | |
| 5,324,064 | A | 6/1994 | Sumser et al. | |
| 5,366,231 | A | 11/1994 | Hung | |
| 5,382,033 | A | 1/1995 | Cheu | |
| 5,409,437 | A | 4/1995 | Lauro et al. | |
| 5,447,319 | A | 9/1995 | Huang | |
| 5,449,185 | A | 9/1995 | Sykes | |
| 5,564,724 | A | 10/1996 | Huang | |
| 5,590,892 | A | 1/1997 | Hu | |
| 5,727,800 | A | 3/1998 | Liu | |
| 5,743,836 | A | 4/1998 | Lo | |
| 5,813,681 | A * | 9/1998 | Saint | A47D 13/043 188/20 |
| 5,813,720 | A | 9/1998 | Huang | |
| 5,820,527 | A | 10/1998 | Lai | |
| 5,845,963 | A | 12/1998 | Huang | |
| 5,888,178 | A | 3/1999 | Welsh, Jr. | |
| 5,938,218 | A | 8/1999 | Chuang | |
| 6,120,045 | A | 9/2000 | Rosko | |
| 6,179,755 | B1 | 1/2001 | Welsh, Jr. | |
| 6,231,056 | B1 | 5/2001 | Wu | |
| 6,244,606 | B1 | 6/2001 | Yang | |
| 6,260,867 | B1 | 7/2001 | Yang et al. | |
| 6,306,066 | B1 | 10/2001 | Yang | |
| 6,361,106 | B1 | 3/2002 | Huang | |
| 6,494,815 | B1 | 12/2002 | Welsh, Jr. | |
| 6,513,869 | B1 | 2/2003 | Wu | |
| 6,616,237 | B2 | 9/2003 | Sonner et al. | |
| 6,719,371 | B2 | 4/2004 | Yoshie et al. | |
| 6,854,799 | B1 | 2/2005 | Asbach et al. | |
| 6,932,709 | B1 | 8/2005 | Gubitosi et al. | |
| 7,614,979 | B2 | 11/2009 | Thomson et al. | |
| 7,779,490 | B2 | 8/2010 | Bergkvist | |
| 7,935,031 | B1 | 5/2011 | Hsiao | |
| 8,016,305 | B2 | 9/2011 | Cheng | |
| 8,162,333 | B1 | 4/2012 | Bartlett | |
| 8,844,072 | B2 | 9/2014 | Bellows et al. | |
| 8,845,028 | B2 | 9/2014 | Miller | |
| 8,894,078 | B2 | 11/2014 | Brewin et al. | |
| 8,919,871 | B2 | 12/2014 | Huntsberger et al. | |
| 9,144,324 | B1 | 9/2015 | Champagne et al. | |
| 9,192,247 | B1 | 11/2015 | Lu | |
| 9,610,211 | B2 | 4/2017 | Lai | |
| 2003/0184036 | A1 | 10/2003 | Wu | |
| 2004/0119258 | A1 | 6/2004 | Yoo | |
| 2005/0054486 | A1 | 3/2005 | Turner et al. | |
| 2010/0078909 | A1 | 4/2010 | Cheng | |
| 2011/0018216 | A1 | 1/2011 | Cheng | |
| 2011/0127810 | A1 | 6/2011 | Lee et al. | |
| 2013/0113240 | A1 | 5/2013 | Huntsberger et al. | |
| 2014/0366276 | A1 | 12/2014 | Chang et al. | |
| 2017/0065099 | A1 | 3/2017 | Burns | |

* cited by examiner

ADJUSTABLE BOUNCING FRAME

CROSS-REFERENCE TO RELATED APPLICATION

This application claims the benefit of U.S. Provisional Patent Application Ser. No. 62/486,508 filed Apr. 18, 2017 and is a continuation-in-part of U.S. Non-Provisional patent application Ser. No. 15/657,565 filed Jul. 24, 2017, which is a continuation of U.S. Non-Provisional patent application Ser. No. 15/259,212 filed Sep. 8, 2016, which claims priority to U.S. Provisional Patent Application Ser. No. 62/215,943 filed Sep. 9, 2015, the entireties of which are hereby incorporated herein by reference for all purposes.

TECHNICAL FIELD

The present invention relates generally to the field of children's support devices, and more particularly to an adjustable bouncing frame for children's support devices, which can be applied to a variety of children's accessories including entertainers, bouncers, walkers, and strollers.

BACKGROUND

Various support devices such as walkers, bouncers, entertainers, and strollers are known for use with toddlers and small children as they develop. Many such devices include a frame to support the child above a support surface. It is often advantageous that the frame be height-adjustable to support the child at a series of heights as the child develops. It is also desirable that the support device be collapsible to a folded position for shipping and storage. It can also be desirable for the support device frame to include a bouncing feature.

Accordingly, it can be seen that need exists for children's support devices with a frame capable of adjusting the height of the support device, folding the device to a storage position, and also incorporating a bouncing feature. It is to the provision of an adjustable bouncing frame meeting these and other needs that the present invention is primarily directed.

SUMMARY

In example embodiments, the present invention provides an adjustable bouncing frame for a child support device including a support frame coupled between a base portion and a child seat platform of the child support device. The support frame is configured to support the child seat platform a distance above the base portion which rests on a support surface. The adjustable bouncing frame generally includes at least one support member that is slidingly coupled to the child support device at a first end. Lateral movement of the first end of the support member can adjust the height of the child seat platform relative to the base. The frame can also include a resilient member that allows for reciprocal lateral motion of the first end of the support member which results in an up-and-down bouncing motion of the child seat platform.

In one aspect, the present invention relates to a bouncing frame for a child support device, the child support device having a base for resting on a support surface and a child support platform supported a distance above the support surface. The bouncing frame comprises at least one support member configured to support the child support platform a distance above the base. A first end of the support member is slidingly attached to either the base or child support platform such that the first end of the support member can move laterally in a motion generally parallel to the support surface. The bouncing frame further comprises at least one resilient member configured to restrict the lateral movement of the first end of the support member to create a reciprocal bouncing motion of the child support platform.

Optionally, two support members are coupled to one another to form an X-shaped frame and the frame is foldable between a folded, storage position and at least one expanded position.

In another aspect, the invention relates to an adjustable bouncing frame for a child support device. The child support device comprises a base for resting on a support surface and a child support platform positioned above the base. The adjustable bouncing frame comprises at least one support member, a height adjustment mechanism, and at least one resilient member. The support member is coupled between the base and the child support platform. The support member is slidingly coupled to the child support platform at a first end and pivotally coupled to the base at a second end. The first end of the support member is able to move laterally along the child support platform. The height-adjustment mechanism is configured to adjust the position of the first end of the support member along the child support platform. The resilient member is configured to restrict the lateral movement of the first end of the support member.

In still another aspect, the invention relates to an adjustable bouncing frame for a device. The device comprises at least one base component configured to rest on a support surface and a support platform supported above the base by the frame. The frame comprises a carriage attached to the support platform, a first support member, and at least one resilient member. The first support member is coupled between the base and the support platform, wherein a first end of the first support member is slidingly coupled to the carriage such that the first end can slide laterally along the carriage, parallel to the support surface. The second end of the first support member is pivotally coupled to the at least one base component. The resilient member is positioned on the carriage to restrict the lateral movement of the first end of the first support member within the carriage. Adjusting the position of the carriage along the support platform adjusts the height of the support platform.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
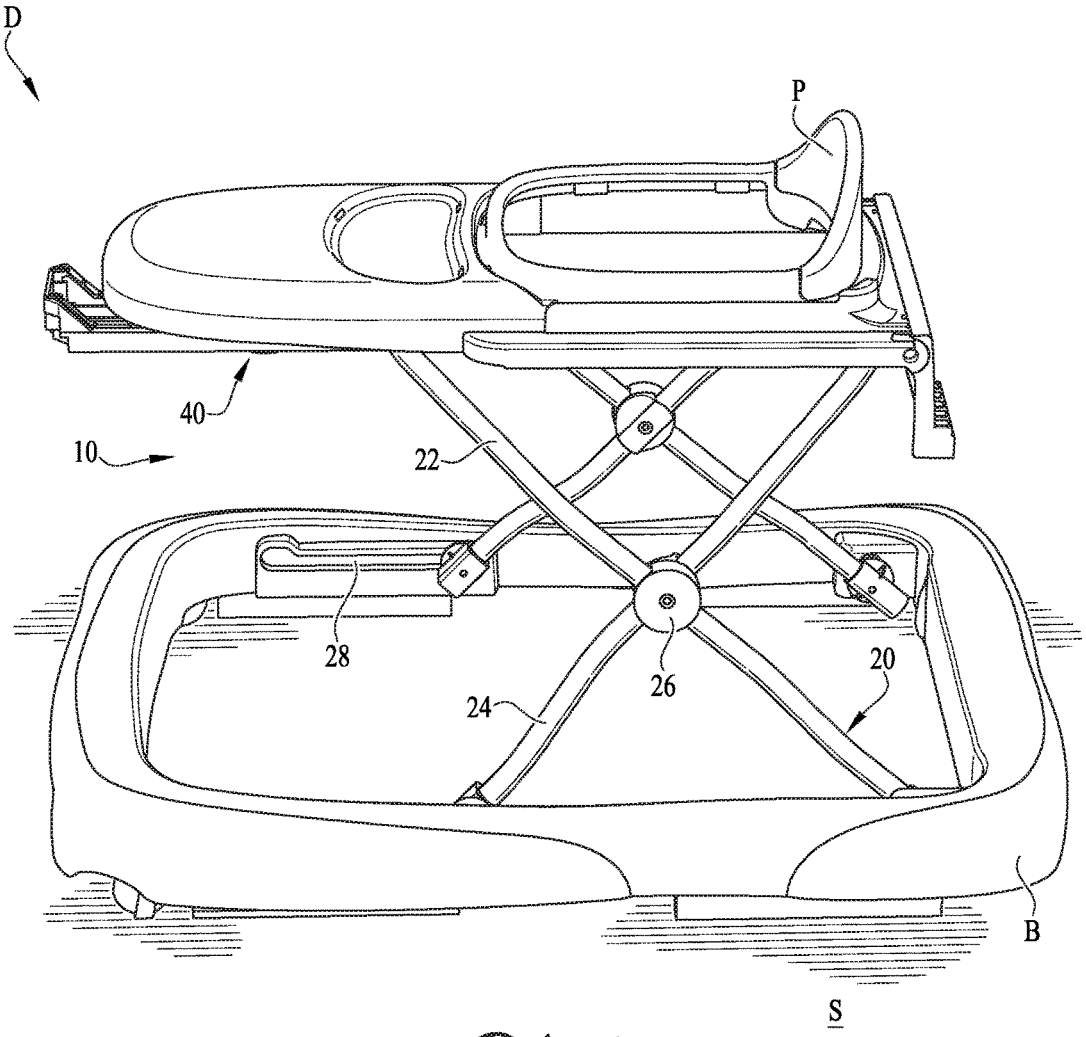
FIG. 1 is a perspective view of a child support device with an adjustable bouncing frame according to an example embodiment of the present invention, with the frame in a first expanded mode.
Figure 2:
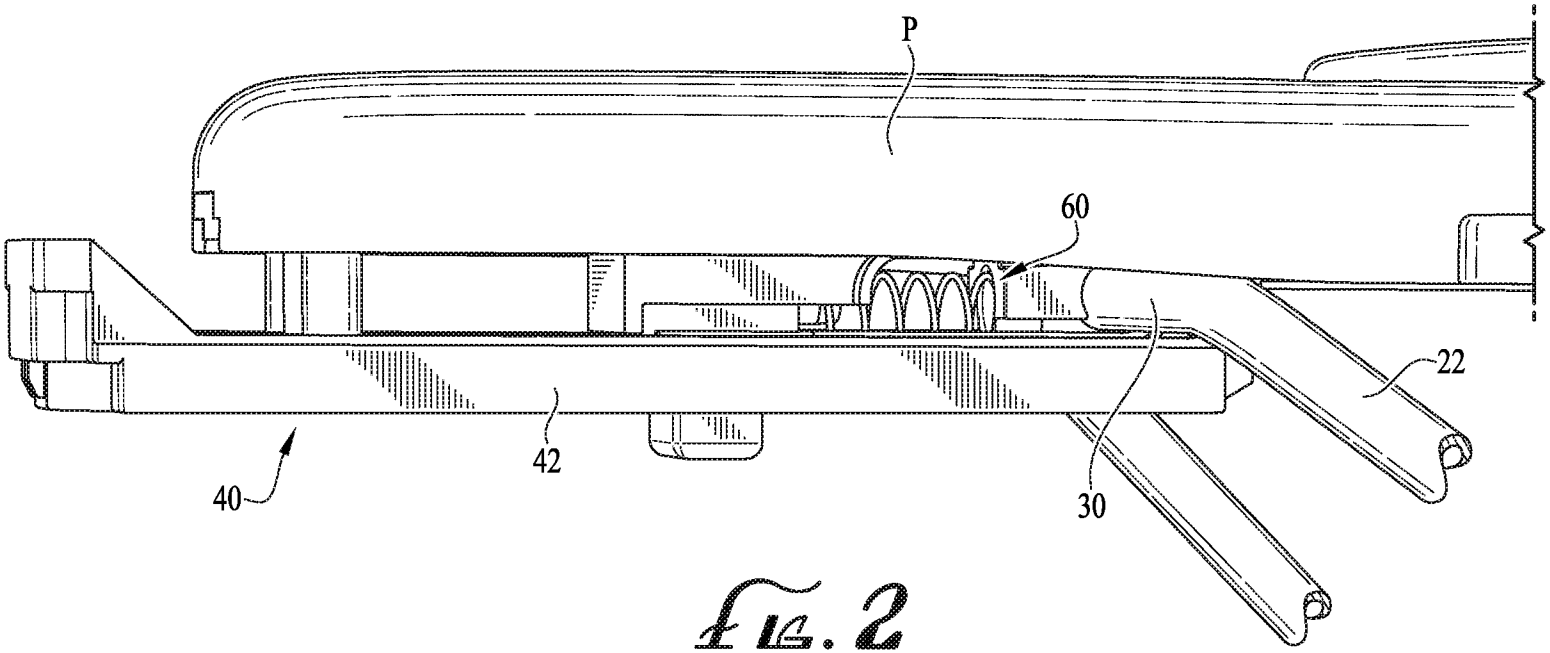
FIG. 2 is a detailed perspective view of the height-adjustment and bounce component of the adjustable bouncing frame of FIG. 1.

With reference now to the drawing figures, wherein like reference numbers represent corresponding parts throughout the several views, FIGS. 1-15 show example embodiments and modes of use of an adjustable bouncing frame 10 for a child support device D. The child support device D can be a children's walker, for example the children's walker shown in U.S. application Ser. No. 15/259,212 filed Sep. 8, 2016, the entirety of which is hereby incorporated herein by reference for all purposes. In other embodiments, the child support device D can be any device configured to support a child above a support surface S, including bouncers, entertainers, and strollers. In example forms, the adjustable bouncing frame 10 includes a support member or support members 20 extending between a support surface S, or base B of the device D, and a child support platform P. The adjustable bouncing frame 10 also generally includes a height-adjustment mechanism 40, shown in detail in FIGS. 2 and 3. In example embodiments, the adjustable bouncing frame 10 also includes a bouncing component 60 that allows the child seat platform P to resiliently bounce up-and-down relative to the support surface S in response to activity and movement of a child seated therein. In still other embodiments, the adjustable bouncing frame includes a bouncing component without a height-adjustment mechanism.

In the depicted embodiment, the support members 20 are comprised of first and second support members 22, 24 extending upward from the base B of the device D to support the child platform P. Generally, each support member 20 is slidingly coupled to either the base B or the support platform P at a first end and each support member is pivotally coupled to the other component of the device D at the second end. In the depicted embodiment, the first support arm 22 is pivotally mounted to the base B of the device D at a first end and attached to the height-adjustment mechanism 40 at a second end. The second support arm 24 is slidingly mounted to the base B at a first end and pivotally attached to the seat platform P at a second end. In other embodiments, the orientations of the first and second support members 22, 24 can be reversed.

Figure 5:
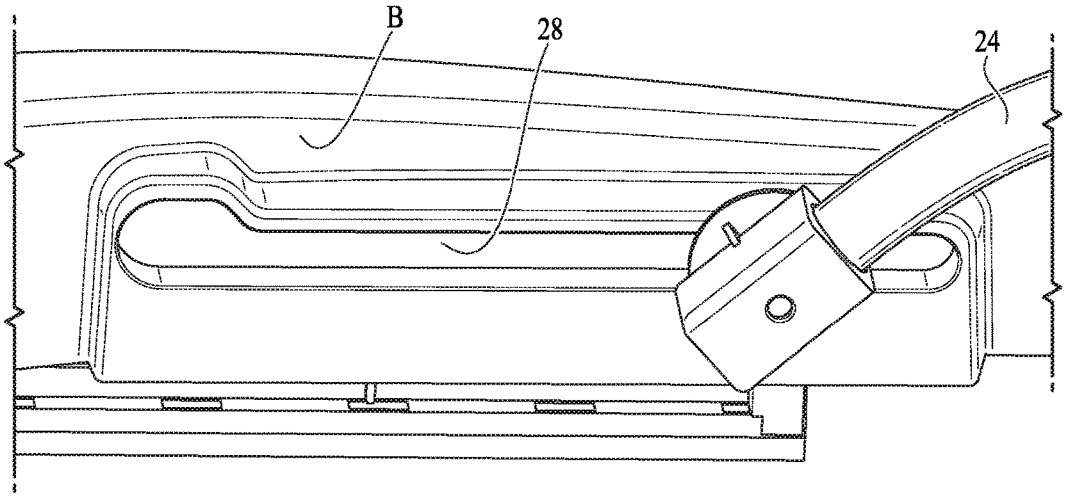
FIG. 5 is a detailed perspective view of the connection between the second support member of the adjustable bouncing frame of FIG. 1 and the base of the child support device.

In the depicted embodiment, the first and second support arms 22, 24 are connected at medial portions thereof by pivotal hubs 26, which allow the support arms to pivot and fold relative to one another. The upper front end of the first support member 22 is attached to the height-adjustment mechanism 40; the lower rear end of the first support member is pivotally coupled to rearward portions of the base B, as shown in detail in FIG. 4. The lower front end of the second support member 24 is slidably mounted to the forward portions of the base B; the upper rear end of the second support member is pivotally coupled to a rearwards portion of the seat platform P. In the depicted embodiment, the lower front end of the second support member 24 is slidably mounted within lower tracks or slots 28 extending laterally along the base B of the device D, as shown in FIG. 5. In other embodiments, other configurations of support members 20 can be used.

Figure 3:
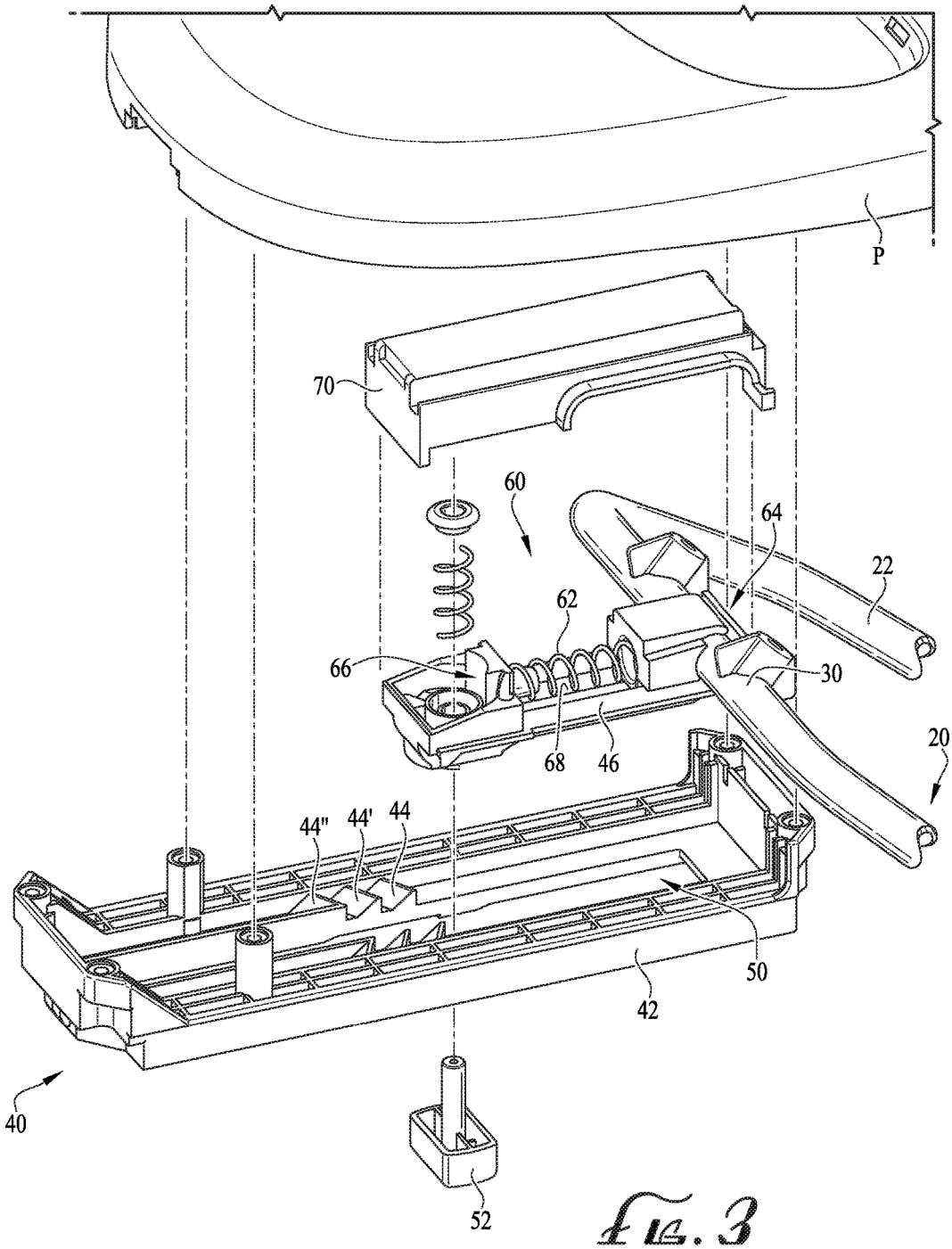
FIG. 3 is an exploded perspective view of the height-adjustment and bounce component of FIG. 2.
Figure 4:
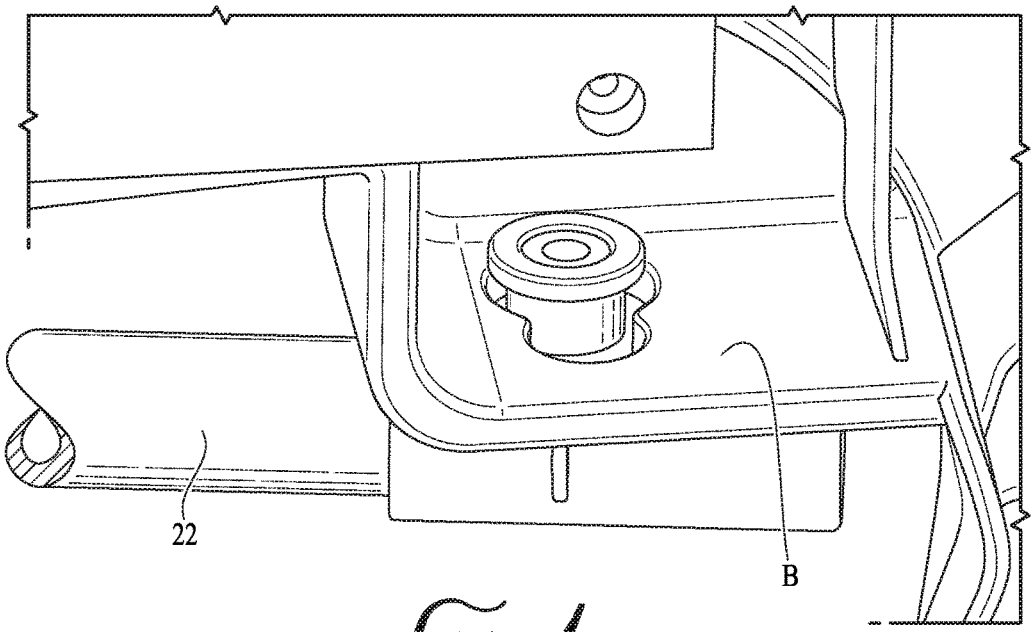
FIG. 4 is a detailed bottom perspective view of the connection between the first support member of the adjustable bouncing frame of FIG. 1 and the base of the child support device.

As shown in FIG. 3, the height-adjustment mechanism 40 generally includes a track 42 attached to the device D. The track 42 is configured to receive the end of a support member 20 that is slidingly attached to the device D. In the depicted embodiment, the track 42 is attached to the seat platform P. The first support arm 22 is slidingly coupled to the track 42 such that an end portion 30 of the first support arm is held between the track and the child platform P. Generally, the position of the end portion 30 of the first support arm 22 along the track 30 determines the height position of the child platform P. In other embodiments, the track can be attached to the base B or base component of the device D. The track 42 includes at least one stop surface or notch 44 configured to hold the end portion 30 of the first support arm 22 at a position along the track and thereby hold the child platform P at a prescribed height. In the depicted embodiment, the track 42 includes a series of stop surfaces 44, 44', 44" along its length. Each stop surface 44, 44', 44" is configured to correspond with a different height of the seat platform P.

In the depicted embodiment, the end portion 30 of the first support arm 22 is attached to a carriage 46 that is configured to slide laterally along the track 42. The carriage 46 includes at least one flange or tooth 48 configured to engage the stop surfaces 44, 44', 44" of the track 42. The carriage 46 generally includes a biasing or locking mechanism 52 that holds the flange 48 in engagement with a stop surface 42 until released by a caregiver that is adjusting the height of the device D. In the depicted embodiment, the track 42 includes an opening or slot 50 extending along a central axis of the track. The carriage 46 includes a knob 52 coupled to the bottom of the carriage and extending through the slot 50. The knob 52 is configured to releasably lock the carriage 46 in a position along the track 42. The knob 52 is dimensioned such that the width of the knob is larger than the width of the opening 50 in the track 42 such that when the knob is positioned perpendicular to the opening, the locked position, it cannot pass through the opening. The knob 52 is spring-biased towards the carriage 46 and thus holds the bottom of the carriage in engagement with the top of the track 42. In the depicted embodiment, the carriage 46 comprises a coil spring to bias the knob 52 toward the carriage. In other embodiments, other biasing or locking mechanisms can be used. In other embodiments, the end portion 30 of the first support member 22 slides directly along the track without the use of a carriage. The end portion 30 can be configured to engage directly with the stop surfaces 44, 44', 44" of the track 42.

Figure 6:
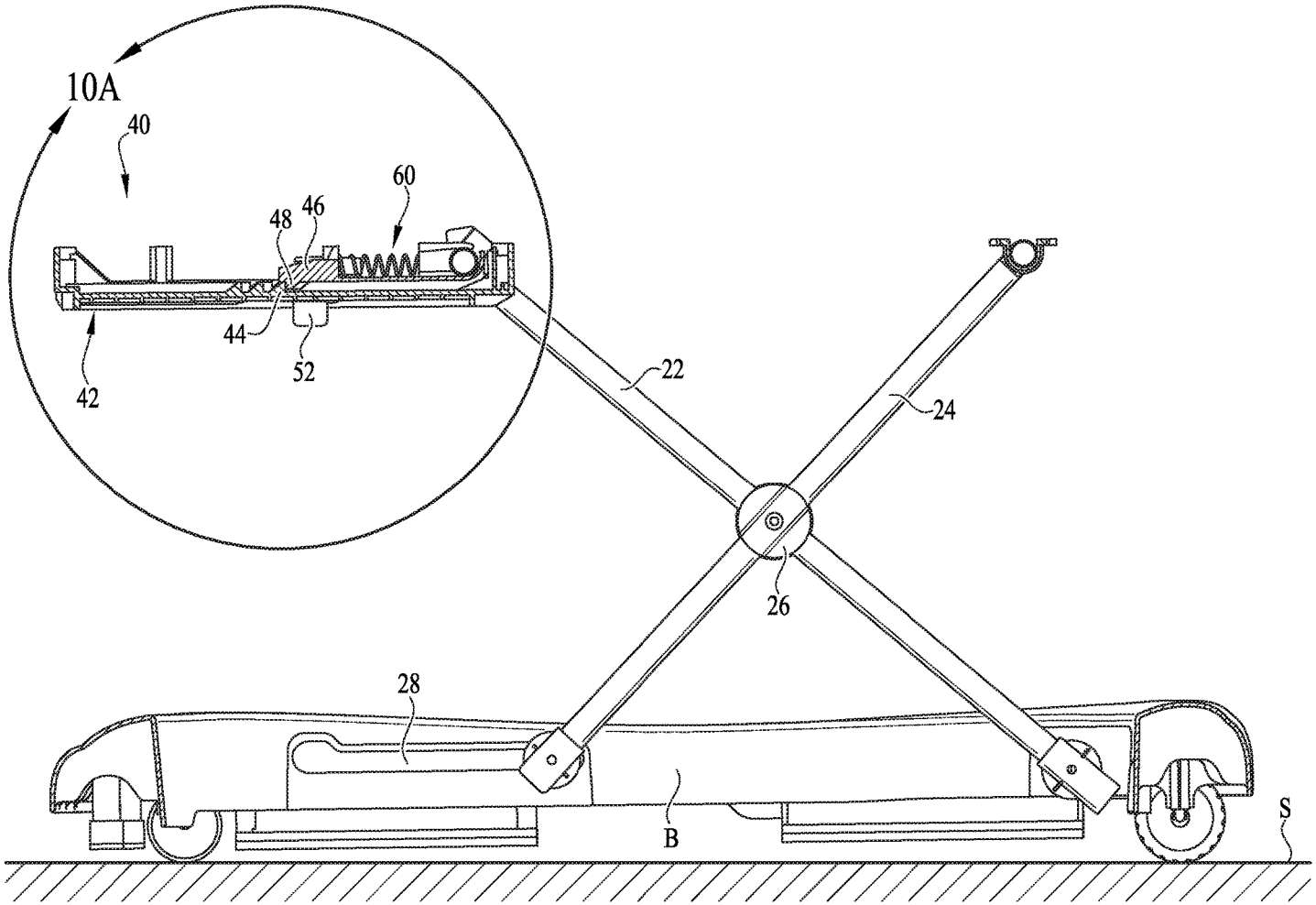
FIG. 6 is a side cutaway view of the adjustable bouncing frame of FIG. 1, with the frame in a first expanded mode.
Figure 7:
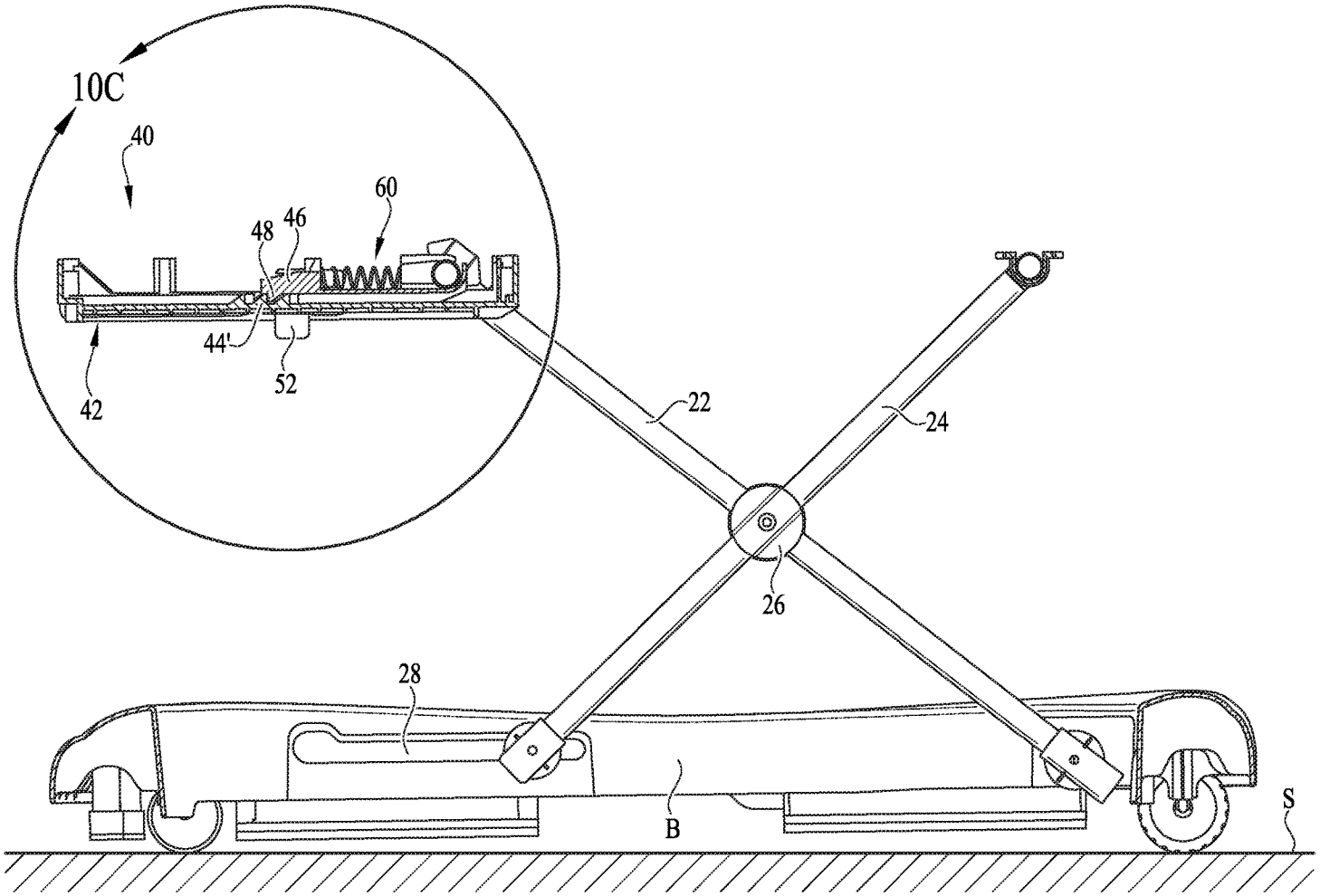
FIG. 7 is a side cutaway view of the adjustable bouncing frame of FIG. 1, with the frame in a second expanded mode.
Figure 8:
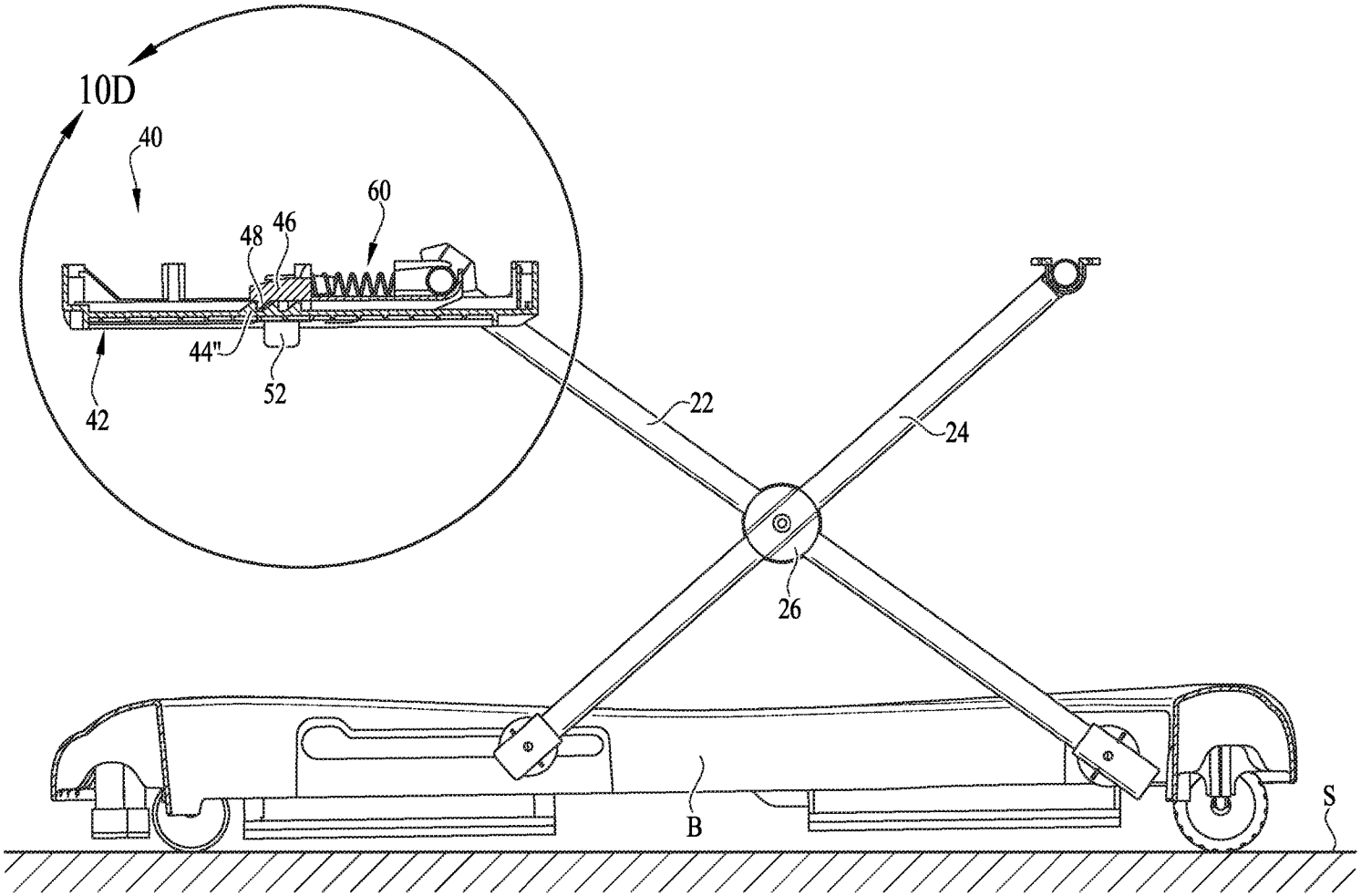
FIG. 8 is a side cutaway view of the adjustable bouncing frame of FIG. 1, with the frame in a third expanded mode.
Figure 9A:
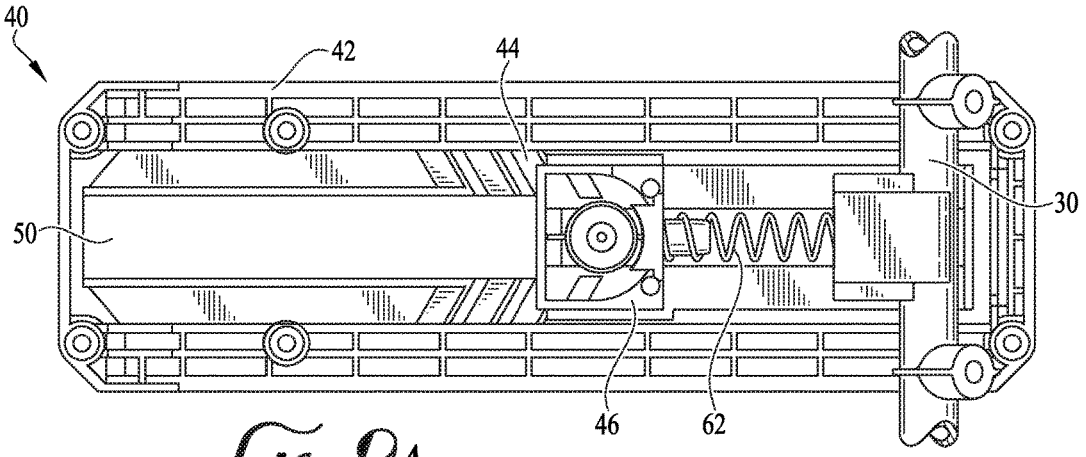
FIGS. 9A-C are top views of the height-adjustment component of FIG. 2 showing the position of the carriage in the first, second, and third expanded modes, respectively.
Figure 9B:
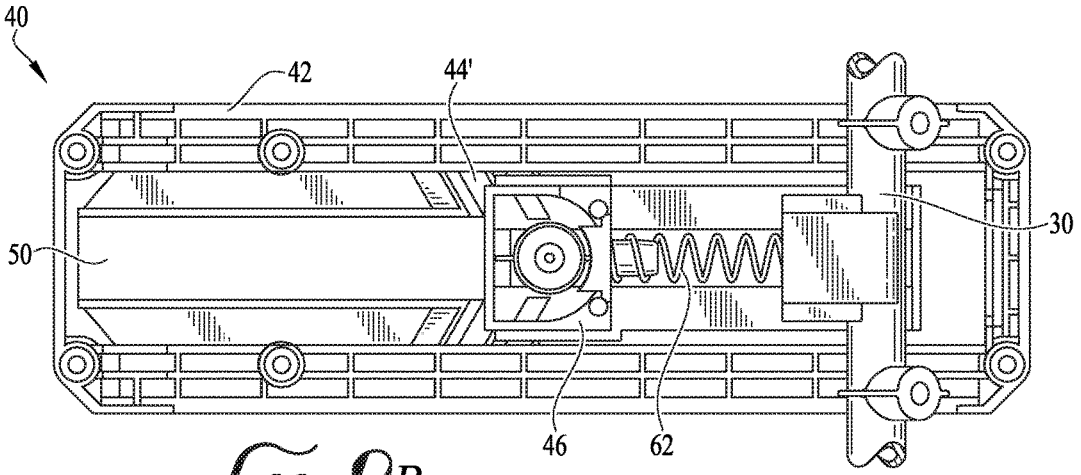
Figure 9C:
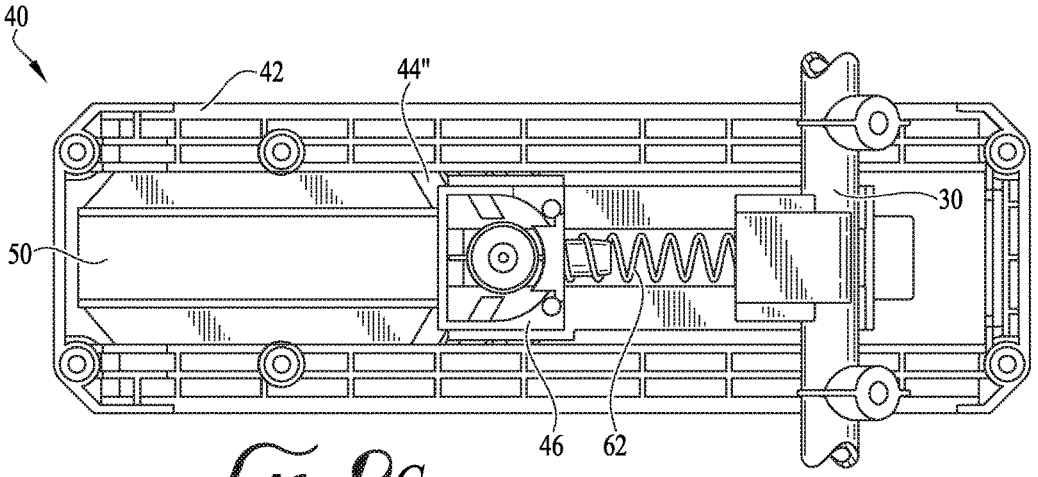

The adjustable bouncing frame 10 of the depicted embodiment includes first, second, and third expanded modes, shown in FIGS. 6, 7, and 8, respectively, corresponding with the three stop surfaces 44, 44', 44". When the flange 48 of the carriage 46 engages the first stop surface 44, the frame 10 is held in a first expanded mode that holds the seat platform P at a first height, shown in FIG. 6 and FIG. 9A. When the flange 48 of the carriage 46 engages the second stop surface 44', the frame 10 is held in a second expanded mode that holds the seat platform P at a second height, shown in FIG. 7 and FIG. 9B. When the flange 48 of the carriage 46 engages the third stop surface 44", the frame 10 is held in a third expanded mode that holds the seat platform P at a second height, shown in FIG. 8 and FIG. 9C. As the carriage 46, and thereby the end portion 30 of the first support arm 22, is moved further along the track 42, the distance between the ends of the support arms 22, 24 is increased, lowering the height of the seat platform P of the child support device D.

Figure 10A:
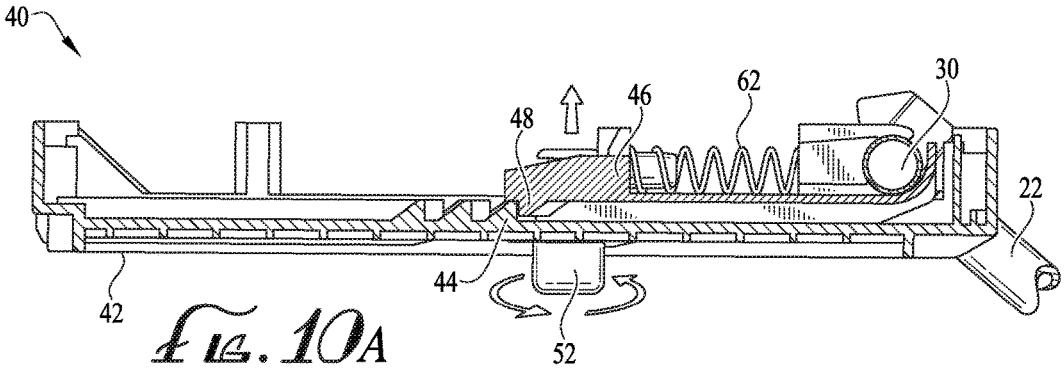
FIGS. 10A-D are cut-away side views of the height-adjustment component of FIG. 2 showing the operation of the height-adjustment component to move the frame between the first, second, and third expanded modes.
Figure 10B:
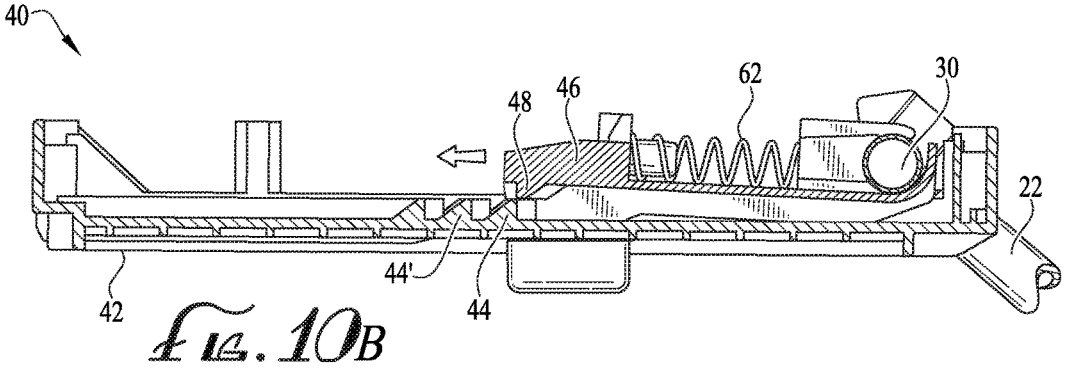
Figure 10C:
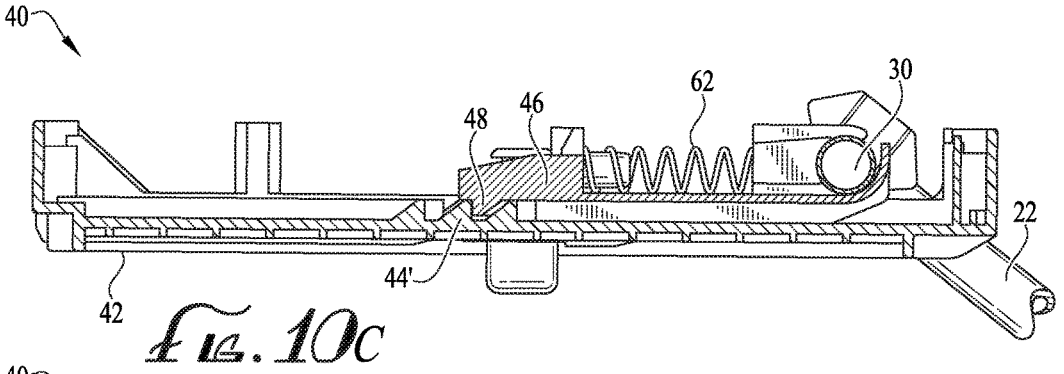
Figure 10D:
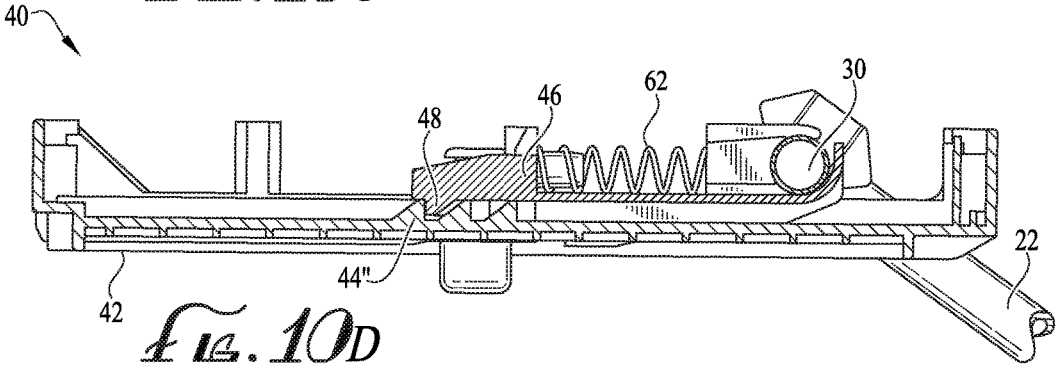
Figure 11A:
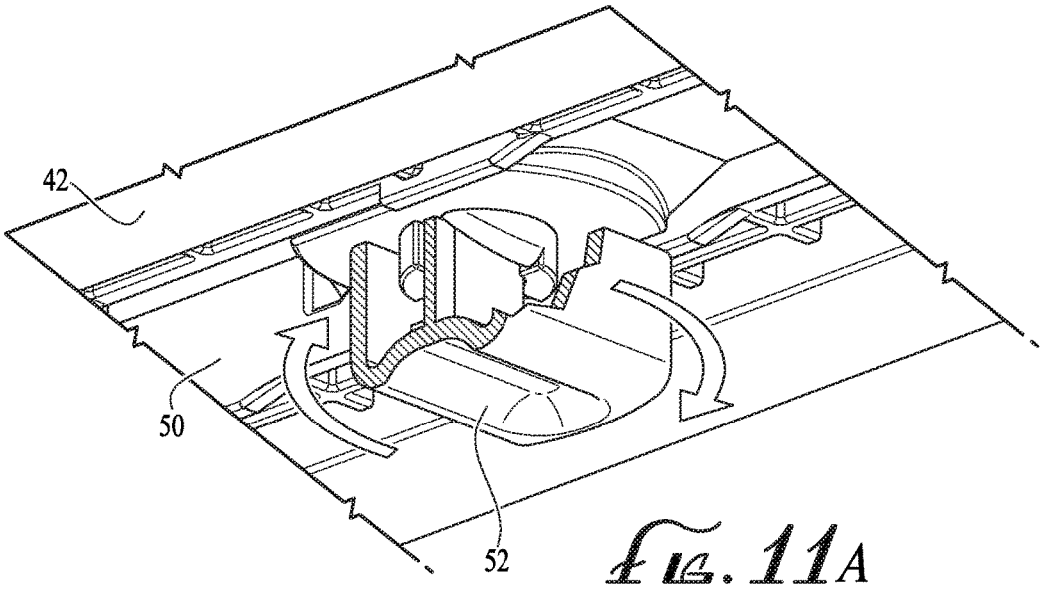
FIGS. 11A-B are detailed perspective views of the locking mechanism of the height-adjustment component of FIG. 2.
Figure 11B:
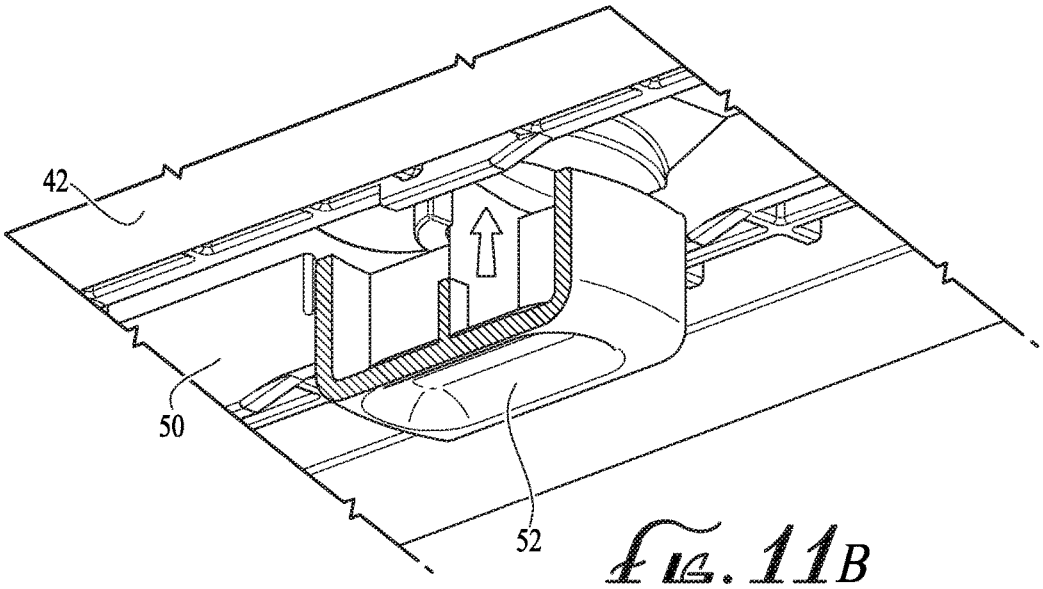

In example embodiments, the spring-biased knob 52 acts as a locking mechanism to lock the frame 10 in an expanded position. In example embodiments, the knob 52 can be rotated, as shown in FIG. 11A, to a position parallel to the opening 50 in the track 42, the unlocked position, shown in FIG. 11B. To change the height of the seat platform P supported by the frame 10, a user twists the knob 52 from the locked position to the unlocked position, as shown in FIG. 10A. The user then pushes the knob 52 upward to force the flange 48 of the carriage 46 out of engagement with the stop surface 44. The carriage 46 can then be pushed laterally until the flange 48 engages the next stop surface 44' as shown in FIGS. 10B and 10C, thus moving the frame 10 from the first expanded position to the second expanded position. The same process is repeated to move the carriage 46 into engagement with the third stop surface 44", as shown in FIG. 10D. In other embodiments, the track 42 can include more or fewer stop surfaces to correspond to the desired heights of the seat platform P.

In example embodiments, the adjustable bouncing frame 10 also includes a bouncing component 60. The bouncing component 60 generally comprises a resilient member 62 that allows the sliding end, in this case the upper end 30, of the first support member 22 to move in a lateral reciprocal motion, as shown in FIGS. 12 and 13. The lateral, side-to-side motion of the upper end 30 of the first support member 22 moves the seat platform P in an up-and-down bouncing motion perpendicular to the support surface. In the depicted embodiment, the resilient member 62 is positioned in the carriage 46 of the height adjustment mechanism 40 such that the seat platform P has the same bouncing motion in each of the plurality of expanded modes. In other words, the range of bouncing motion of the seat platform P remains the same as the height of the seat platform P is adjusted.

As shown in detail in FIG. 3, the carriage 46 generally includes a first end 64 and a second end 66. The carriage 46 also comprises a track 68 running along the bottom of the carriage between the first end 64 and the second end 66. The upper end 30 of the first support member 22 is slidingly coupled to the carriage 46 such that the upper end 30 can slide laterally along the track 68. The upper end 30 of the first support member 22 is biased towards the first end 64 of the carriage 46. The resilient member 62 is positioned between the upper end 30 of the first support member 22 and the second end 66 of the carriage 46 to bias the upper end toward the first end 64 of the carriage. In the depicted embodiment, the resilient member 62 is a coil spring, for example formed of steel or other metal. In other embodiments, the resilient member 62 can be formed from any resilient, deformable material including rubber, foam, or polymeric materials such as for example DuPont Hytrel®. Different strength springs can be used depending on the desired degree of bounce. In different embodiments, the length of the carriage can be adjusted to determine the bounce height. In the depicted embodiment, the track 42 and carriage 46 move in a lateral motion parallel to the support surface. In other embodiments, the track and/or carriage can move at an angle relative to the support surface.

Figure 12A:
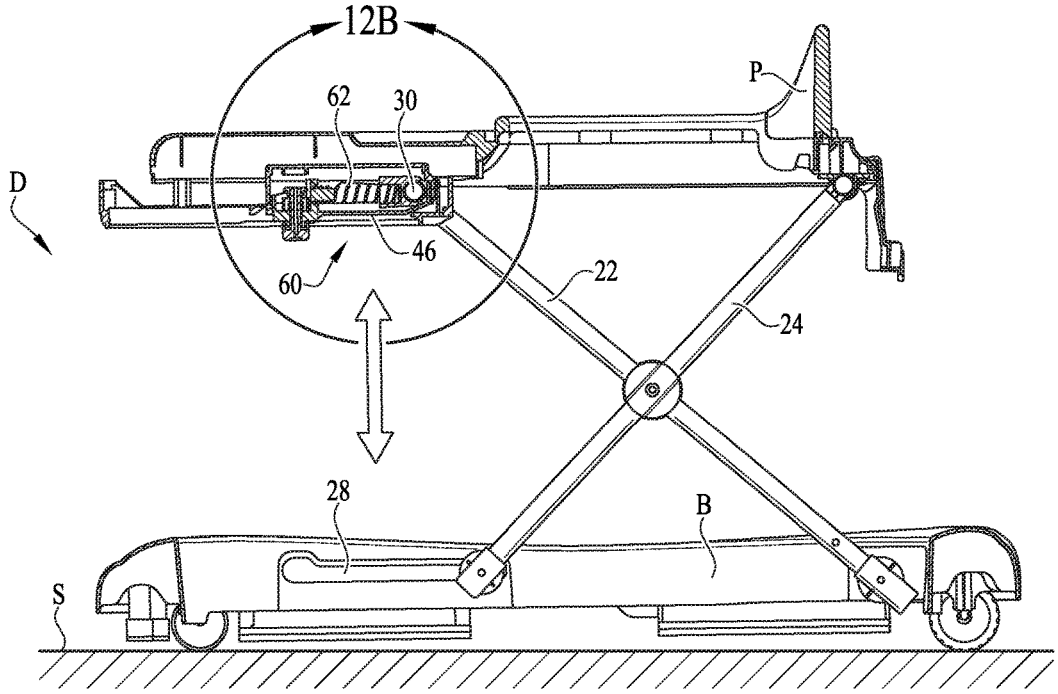
FIGS. 12A-B are side cut-away views of the adjustable bouncing frame of FIG. 1, in an uncompressed position.
Figure 12B:
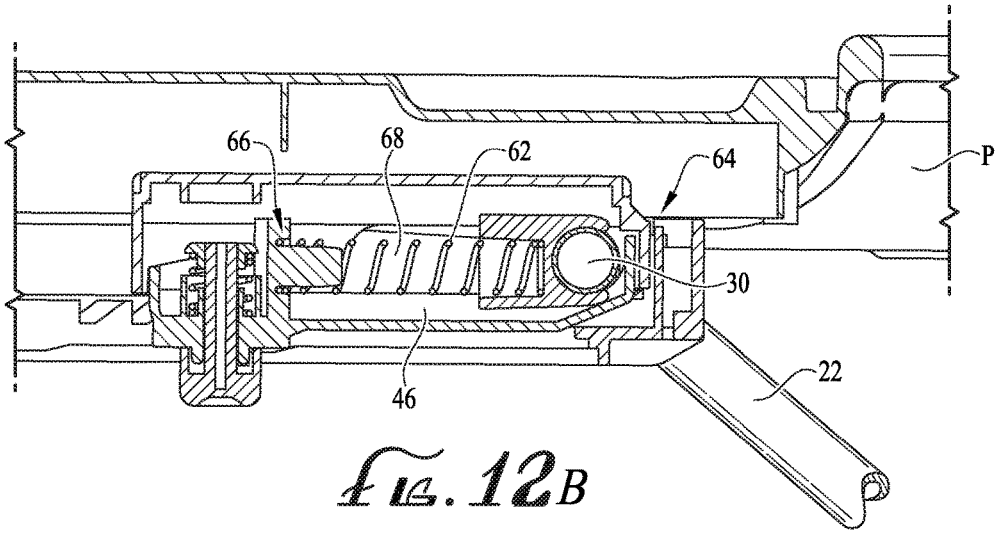
Figure 13A:
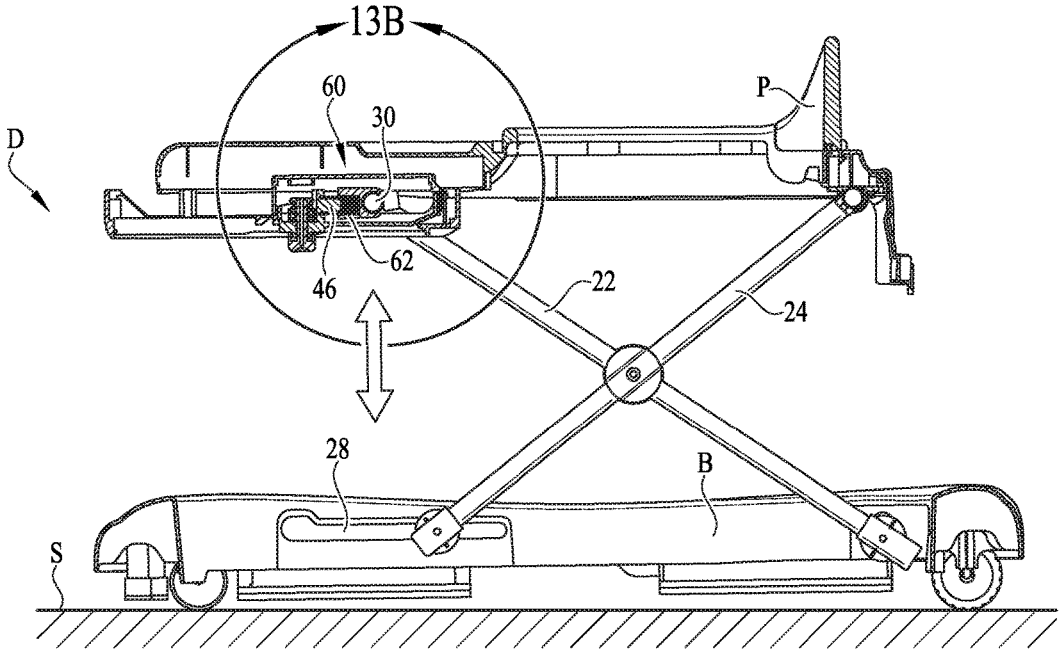
FIGS. 13A-B are side cut-away views of the adjustable bouncing frame of FIGS. 12A-B, in a compressed position.
Figure 13B:
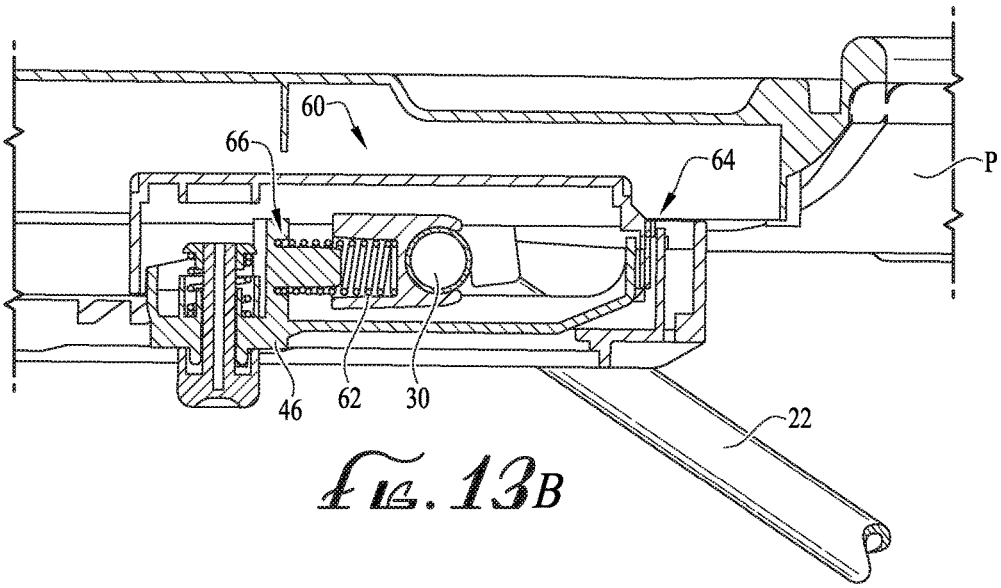

In use, the resilient member 62 holds the upper end 30 of the first support member 22 at the first or rear end 64 of the carriage 46 as show in FIG. 12B. This holds the seat platform P at its maximum height, as shown in FIG. 12A. When a force is applied to the seat platform P, the resilient member 62 compresses to allow the upper end 30 of the first support member 22 to move laterally towards the second or front end 66 of the carriage 46, as shown in FIG. 13B. The forward lateral motion of the upper end 30 of the first support member 22 pulls the seat platform P down to temporarily reduce the height of the seat platform, as shown in FIG. 13A. The snap of the resilient member 62 creates a reciprocal motion that causes the seat platform P to bounce for a period of time before returning to its original height. The bottom end of the second support member 24 is able to slide along the track 28 in the device base B to accommodate the change in height of the seat platform P. The entire carriage 46 moves along the track 42 as the height of the device D is adjusted. Therefore the degree of bounce of the frame 10 remains the same in each of the expanded modes of the frame.

The carriage 46 optionally includes a carriage cover 70 configured to fit over the top of the carriage. The carriage cover 70 is configured to help protect the components within the carriage as it moves along the track 42. In other embodiments, the carriage 42 can include a locking mechanism configured to hold the upper end 30 of the first support member in place at the first end 64 of the carriage 42, thereby preventing the bouncing motion of the seat platform P. The locking mechanism could be activated or deactivated using a user input, for example a button or lever. Thus the caregiver would have the option to allow the child device D to bounce or hold the seat platform P at a prescribed height.

In other embodiments, the frame 10 can include a bouncing component 40 but not a height adjustment component. In this example embodiment, the upper end of the first support member is slidably attached directly to a track that is attached to a child seat platform. The track includes a resilient member configured to restrict the lateral movement of the upper end of the first support member. In other embodiments, the coupling between the device D and the second support member 24 can also include a bouncing component to allow a child within the device to receive a receptacle bounce. In other embodiments, the height-adjustment mechanism and/or bouncing component are positioned on the base of the child support device.

Figure 14:
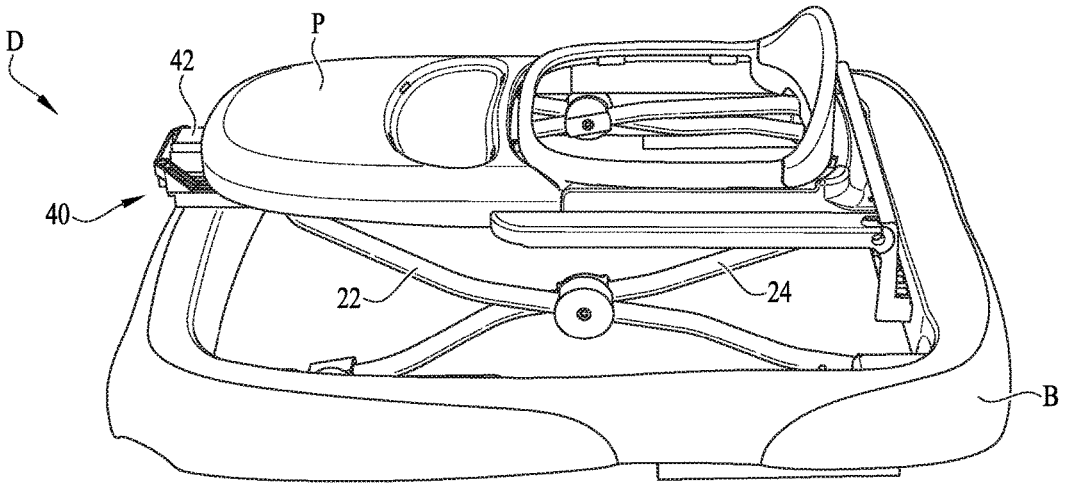
FIG. 14 is a perspective view of the adjustable bouncing frame of FIG. 1, in a storage position.
Figure 15:
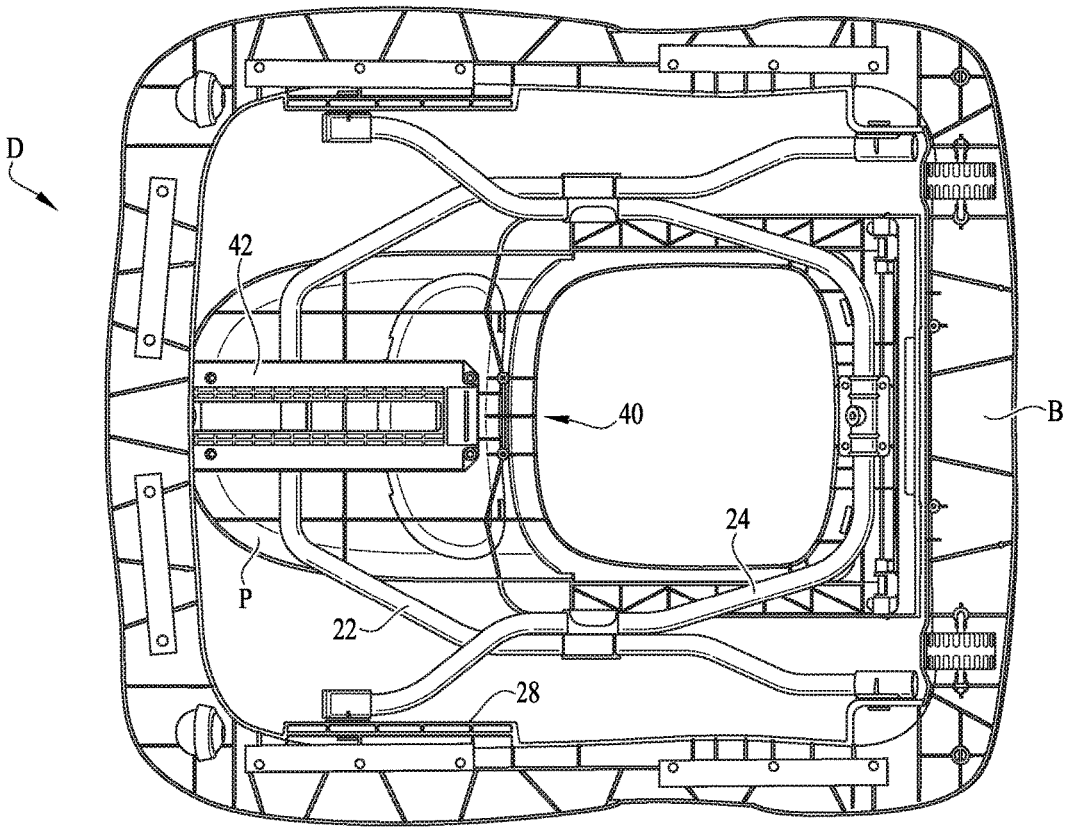
FIG. 15 is a bottom view of the adjustable bouncing frame of FIG. 14.

In example embodiments, the support frame 10 is collapsible to a compact position for storage or transport when not in use, as shown in FIGS. 14 and 15. To move the device D to the storage position, the height adjustment mechanism 40 is moved to the unlocked position and the upper end 30 of the first support member 22 is moved towards the front end of the track 42. The bottom end of the second support member 24 also moves toward the front end of the slot 28 in the base B of the device. This movement shortens the vertical distance between the base B of the device D and the seating platform P to lower the dimensions of the device for packaging and storage.

While the invention has been described with reference to example embodiments, it will be understood by those skilled in the art that a variety of modifications, additions and deletions are within the scope of the invention, as defined by the following claims. For example, the use of the adjustable bouncing frame of the present invention is not limited to child support device. The frame can be used in any device where adjustment of device height and/or bounce is desired. Moreover, the particular configurations, materials of construction, and objectives described herein are merely exemplary and are in no way limiting.

What is claimed is:

1. A bouncing frame for a child support device, wherein the child support device comprises a base for resting on a support surface and a child support platform, the bouncing frame comprising:

at least one support member configured to support the child support platform a distance above the base, wherein a first end of the at least one support member is slidingly attached to either the base or the child support platform such that the first end of the at least one support member is movable laterally in a motion parallel to the support surface; and at least one resilient member configured to restrict the lateral movement of the first end of the at least one support member;

wherein the first end of the at least one support member is slidingly coupled to the base and a second end of the at least one support member is pivotally coupled to the child support platform.

2. The bouncing frame of claim 1, wherein the at least one resilient member comprises a compression spring.

3. The bouncing frame of claim 1, wherein the first end of the at least one support member is slidingly coupled to the child support platform and a second end of the at least one support member is pivotally coupled to the base.

4. The bouncing frame of claim 1, comprising two support members.

5. The bouncing frame of claim 4, wherein the two support members are coupled to one another to form an X-shaped frame.

6. The bouncing frame of claim 5, wherein the two support members are movable between a folded, storage position and at least one expanded position.

7. An adjustable bouncing frame for a child support device, wherein the child support device comprises a base for resting on a support surface and a child support platform positioned above the base, the adjustable bouncing frame comprising:

at least one support member coupled between the base and the child support platform, wherein the at least one support member is slidingly coupled to the child support platform at a first end and pivotally coupled to the base at a second end, wherein the first end of the at least one support member is movable laterally along the child support platform;

a height adjustment mechanism configured to adjust the position of the first end of the at least one support member along the child support platform; and at least one resilient member configured to restrict the lateral movement of the first end of the at least one support member;

wherein the height adjustment mechanism comprises a carriage that is movable along the child support platform, and wherein the first end of the at least one support member is slidingly coupled to the carriage.

8. The adjustable bouncing frame of claim 7, wherein the at least one resilient member is positioned to restrict the lateral movement of the first end of the at least one support member within the carriage.

9. The adjustable bouncing frame of claim 7, further comprising a track coupled to the child support platform, wherein the carriage is movable to different positions along the track to adjust the height of the child support platform relative to the base.

10. The adjustable bouncing frame of claim 9, further comprising a releasable locking mechanism that is movable between a locked position and an unlocked position and is configured to hold the carriage at a position along the track.

11. The adjustable bouncing frame of claim 10, wherein the locking mechanism is spring-biased in the locked position.

12. The adjustable bouncing frame of claim 9, wherein adjustable bouncing frame is movable between at least one expanded position and a storage position.

13. An adjustable bouncing frame for a device, wherein the device comprises at least one base component configured to rest on a support surface and a support platform supported above the base by the frame, the frame comprising:

a carriage attached to the support platform;

a first support member coupled between the base and the support platform, wherein a first end of the first support member is slidingly coupled to the carriage such that the first end is slidable laterally along the carriage, parallel to the support surface, and wherein a second end of the first support member is pivotally coupled to the at least one base component; and at least one resilient member positioned on the carriage to restrict the lateral movement of the first end of the first support member;

wherein the position of the carriage along the support platform is adjustable to change the height of the support platform.

14. The adjustable bouncing frame of claim 13, further comprising a second support member pivotally coupled to a medial portion of the first support member to form an X-shaped frame.

15. The adjustable bouncing frame of claim 14, wherein a first end of the second support member is slidingly coupled to the at least one base component and a second end of the second support member is pivotally coupled to the support platform.

16. The adjustable bouncing frame of claim 13, further comprising a track coupled to the support platform, wherein the carriage is slidingly coupled to the track.

17. The adjustable bouncing frame of claim 16, wherein the carriage further comprising a releasable locking mechanism that is movable between a locked position and an unlocked position and is configured to hold the carriage at a position along the track.

18. The adjustable bouncing frame of claim 16, wherein adjustable bouncing frame can move between at least one expanded position and a storage position.

* * * * *